US010222072B2

(12) United States Patent
Martini et al.

(10) Patent No.: US 10,222,072 B2
(45) Date of Patent: Mar. 5, 2019

(54) FAN FOR OVENS FOR COOKING FOODS

(71) Applicant: MA.TI.KA. S.R.L., Milan (IT)

(72) Inventors: Oscar Martini, Borgoricco (IT); Enrico Martini, Camposampiero (IT)

(73) Assignee: MA.TI.KA. S.R.L., Milan (IT)

( * ) Notice: Subject to any disclaimer, the term of this patent is extended or adjusted under 35 U.S.C. 154(b) by 399 days.

(21) Appl. No.: 15/226,932

(22) Filed: Aug. 3, 2016

(65) Prior Publication Data

US 2017/0038080 A1 Feb. 9, 2017

(30) Foreign Application Priority Data

Aug. 3, 2015 (IT) ..... 102015000041518

(51) Int. Cl.

| | |
|---|---|
| ***F04D 17/16*** | (2006.01) |
| ***F04D 29/28*** | (2006.01) |
| ***F04D 29/30*** | (2006.01) |
| ***F24C 15/32*** | (2006.01) |

(52) U.S. Cl.

CPC ..... *F24C 15/322* (2013.01); *F04D 17/16* (2013.01); *F04D 29/281* (2013.01); *F04D 29/30* (2013.01); *F05B 2250/711* (2013.01); *F05B 2250/712* (2013.01)

(58) Field of Classification Search

CPC ..... F04D 17/16; F04D 29/281; F04D 29/30; F05B 2250/711; F05B 2250/712

See application file for complete search history.

(56) References Cited

U.S. PATENT DOCUMENTS

| | | | | |
|---|---|---|---|---|
| 3,221,398 | A | 12/1965 | Mayne | |
| 4,231,706 | A * | 11/1980 | Ueda | F04D 29/281 416/186 R |
| 5,707,209 | A * | 1/1998 | Iyer | F04D 29/282 416/186 R |
| 6,695,584 | B2 * | 2/2004 | Kim | F04D 29/30 416/186 R |
| 8,834,121 | B2 * | 9/2014 | Ikeda | F04D 25/088 416/186 R |
| 9,528,374 | B2 * | 12/2016 | Ikeda | F04D 29/281 |
| 2011/0023526 | A1 * | 2/2011 | Ohyama | F04D 29/30 62/426 |
| 2012/0055656 | A1 * | 3/2012 | Han | F04D 29/281 165/122 |
| 2015/0176594 | A1 * | 6/2015 | Gebert | F04D 29/282 416/186 R |
| 2015/0226227 | A1 * | 8/2015 | Ikeda | F04D 29/281 416/182 |

FOREIGN PATENT DOCUMENTS

| | | | |
|---|---|---|---|
| DE | 102010002673 | A1 | 9/2011 |
| DE | 102013106909 | A1 | 1/2014 |
| WO | 2014061642 | A1 | 4/2014 |

* cited by examiner

*Primary Examiner* — Igor Kershteyn

(74) *Attorney, Agent, or Firm* — Mark M. Friedman

(57) ABSTRACT

Fan for ovens for cooking foods, which comprises: a support plate arranged substantially orthogonal to the rotation axis of the fan; and multiple blades projectingly fixed on the support plate and radially arranged around the rotation axis. Each blade of the fan is provided with an internal edge, which is shaped with a convex portion that is projectingly extended between a first and a second concavity of the internal edge itself.

14 Claims, 8 Drawing Sheets

FAN FOR OVENS FOR COOKING FOODS

FIELD OF APPLICATION

The present invention regards a fan for ovens for cooking foods.

The present fan is inserted in the field of production of ovens and of oven components, which are intended to be advantageously employed in the food industry for preparing foods for human consumption.

Such ovens, in particular, are intended to be employed professionally, for example in the restaurant, gastronomy, confectionary and bakery fields.

STATE OF THE ART

Ovens for professional use are known on the market; these conventionally comprise a load-bearing structure with box-like shape, which at its interior delimits a cooking chamber in which the foods to be cooked are intended to be introduced.

More in detail, the load-bearing structure comprises a lower wall, an upper wall and two lateral walls, which together delimit the aforesaid cooking chamber. The load-bearing structure also comprises a bottom wall placed as a rear closure of the cooking chamber. The load-bearing structure is provided on the front part with an access opening to the cooking chamber in order to allow introducing foods to be cooked in the cooking chamber and in order to extract such foods from the latter upon completed cooking. A door is provided that is hinged to the load-bearing structure and drivable for closing the access opening during the cooking of the foods.

The oven also comprises heating means adapted to heat the air inside the cooking chamber, and a fan (in particular of centrifugal type) arranged inside the cooking chamber and drivable for generating a flow of hot air that circulates in the cooking chamber itself in order to uniformly cook the foods.

More in detail, the fan is positioned at the bottom wall of the load-bearing structure and is fixed to a horizontal rotation shaft mechanically connected to an electric motor that is drivable in order to rotate the fan itself.

The heating means of the oven comprise an electrical heating element with circular shape and arranged around the fan in order to heat the air flow generated by the fan itself, as described more in detail hereinbelow.

In particular, the fan comprises a support disc, which is provided with a central hub fixed to the rotation shaft and bears a plurality of blades mounted thereon that are radially arranged around the rotation shaft itself.

More in detail, each blade has substantially plate-like shape and is extended parallel to the rotation shaft between a rear edge thereof, fixed to the support disc, and a front edge thereof fixed to a front ring which delimits a central opening of the fan.

In addition, each blade is extended, in radial direction with respect to the rotation shaft, between a substantially rectilinear external edge and an internal edge directed towards the rotation shaft and having a rectilinear progression tapered from the support disc to the front ring of the fan.

In operation, when the fan is rotated, it actually suctions the air through the central opening of the front ring, and radially expels the pressurized air through the openings between the blades, in a manner such that the air flow intercepts the electrical heating element, absorbing the heat thereof, and it is then propagated inside the cooking chamber in order to bring the heat to the foods to be cooked.

One drawback of the ovens of known type briefly mentioned above is due to the fact that the air flow suctioned by the fan has high turbulences, which generate high friction resistance between the air and the blades of the fan itself (due in particular to the losses of quantity of motion of the air molecules due to the mixing of the particles themselves), therefore determining significant load losses. Consequently, the motor of the oven must deliver high power in order to rotate the fan at the speed necessary for obtaining a suitable air flow rate inside the cooking chamber, with a consequent high energy consumption.

PRESENTATION OF THE INVENTION

In this situation, the problem underlying the present invention is therefore that of overcoming the abovementioned drawbacks by providing a fan for ovens for cooking foods capable of operating with a high energy efficiency.

A further object of the present invention is to provide a fan for ovens that is entirely reliable in operation.

A further object of the present invention is to provide a fan for ovens capable of operating with a reduced noise level.

A further object of the present invention is to provide a fan for ovens that is structurally simple and inexpensive to achieve.

These and still other objects are achieved by the fan according to the below-reported claims.

BRIEF DESCRIPTION OF THE DRAWINGS

The technical characteristics of the invention, according to the aforesaid objects, can be clearly seen from the contents of the below-reported claims, and the advantages thereof will be more evident from the following detailed description, made with reference to the enclosed drawings, which represent some merely exemplifying and non-limiting embodiments of the invention, in which:

DETAILED DESCRIPTION OF A PREFERRED EMBODIMENT

With reference to the enclosed drawings, reference number 1 overall indicates a fan, object of the present invention.

Advantageously, the present fan 1 is adapted to be installed in an oven 100 which, in particular, is intended to be employed professionally, e.g. in the restaurant, gastronomy, confectionary and bakery fields.

Figure 1:
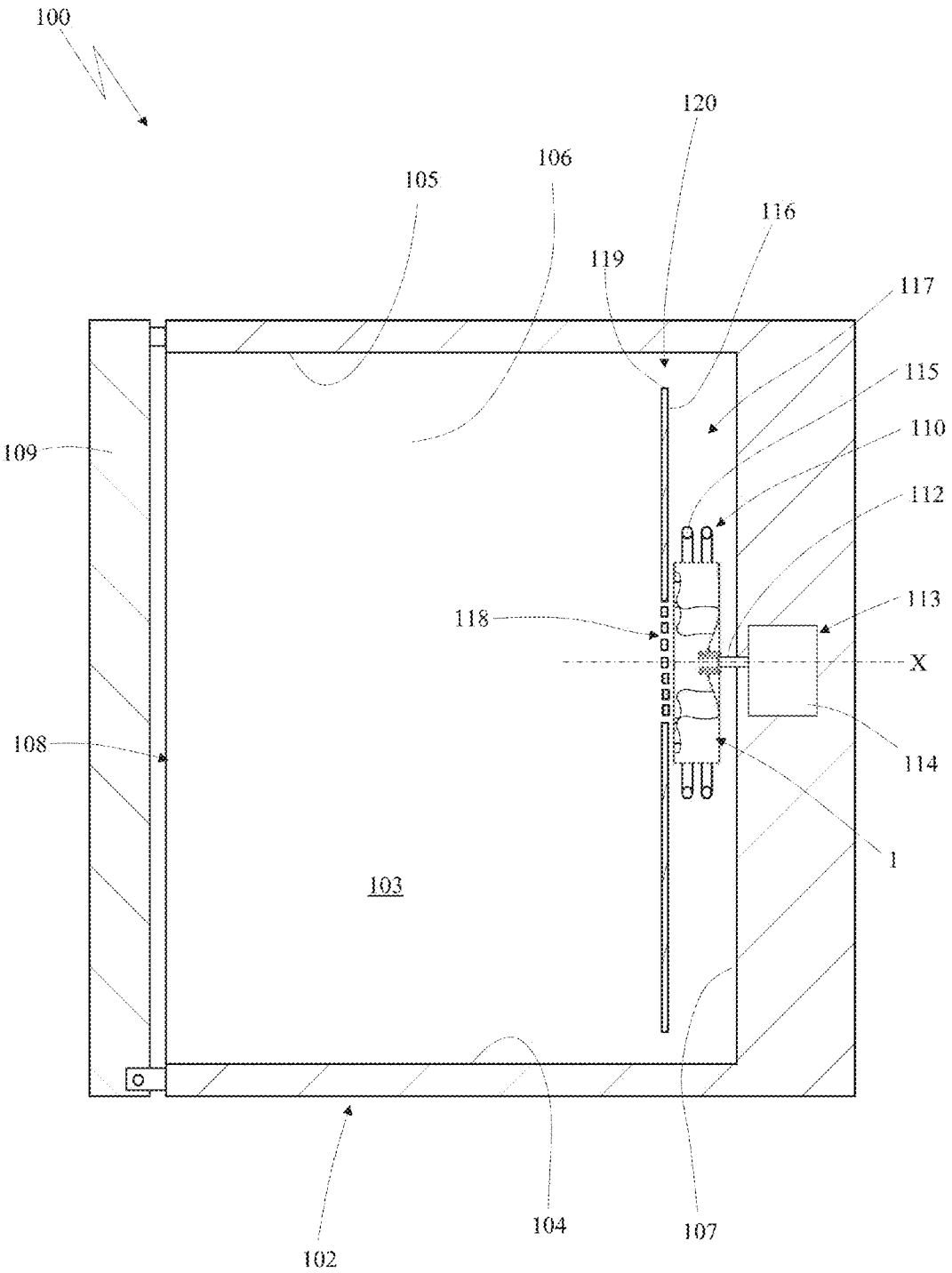
FIG. 1 illustrates a schematized side section view of one embodiment of an oven for cooking foods in which the fan, object of the present invention, is intended to be mounted.

With reference to the embodiment illustrated in FIG. 1, the oven 100 comprises a support structure 102 that encloses a cooking chamber 103, inside which the foods to be cooked are intended to be arranged.

Preferably, the support structure 102 has substantially box-like shape and comprises a lower wall 104 and an upper wall 105 that are parallel to each other and facing, and two lateral walls 106 placed to connect the upper and lower walls 104 and 105. Such walls 104, 105, 106 together delimit the aforesaid cooking chamber 103.

The support structure 102 of the oven 100 also comprises a bottom wall 107 fixed to the upper lower and lateral walls 104-106 as a rear closure of the cooking chamber 103.

The support structure 102 is provided with an access opening 108 to the cooking chamber 103, such opening 108 is preferably positioned opposite the bottom wall 107 of the support structure 102 itself.

Advantageously, the oven 100 comprises a door 109 which is hinged to the support structure 102 and is movable between a closed position, in which it obstructs the access opening 108, and an open position, in which the access opening 108 is not obstructed by the door 109 in order to allow the introduction and extraction of the foods into and from the cooking chamber 103.

The oven 100 comprises heating means 110 mounted on the support structure 102, operatively associated with the cooking chamber 103, and drivable for heating the air inside the latter, in order to cook the foods arranged inside the cooking chamber 103 itself.

The fan 1, object of the present invention, is intended to be arranged inside the cooking chamber 103 of the oven 100, and is drivable for generating inside such chamber 103 a recirculation air flow adapted to uniformly distribute the hot air inside the cooking chamber 103 itself.

In particular, the fan 1 is intended to be arranged inside the cooking chamber 103 of the oven 100 at one of the walls 104-107 of the support structure 102 and, preferably, at the bottom wall 107.

Advantageously, the fan 1 is adapted to be fixed to a rotation shaft 112 rotatably constrained to the support structure 102 and in particular arranged to traverse the bottom wall 107 with axis orthogonal to the latter.

The oven 100 is provided with movement means 113 comprising preferably an electric motor 114, which is mechanically connected to the rotation shaft 112 and is drivable for rotating the latter in order to move the fan 1.

Figure 2:
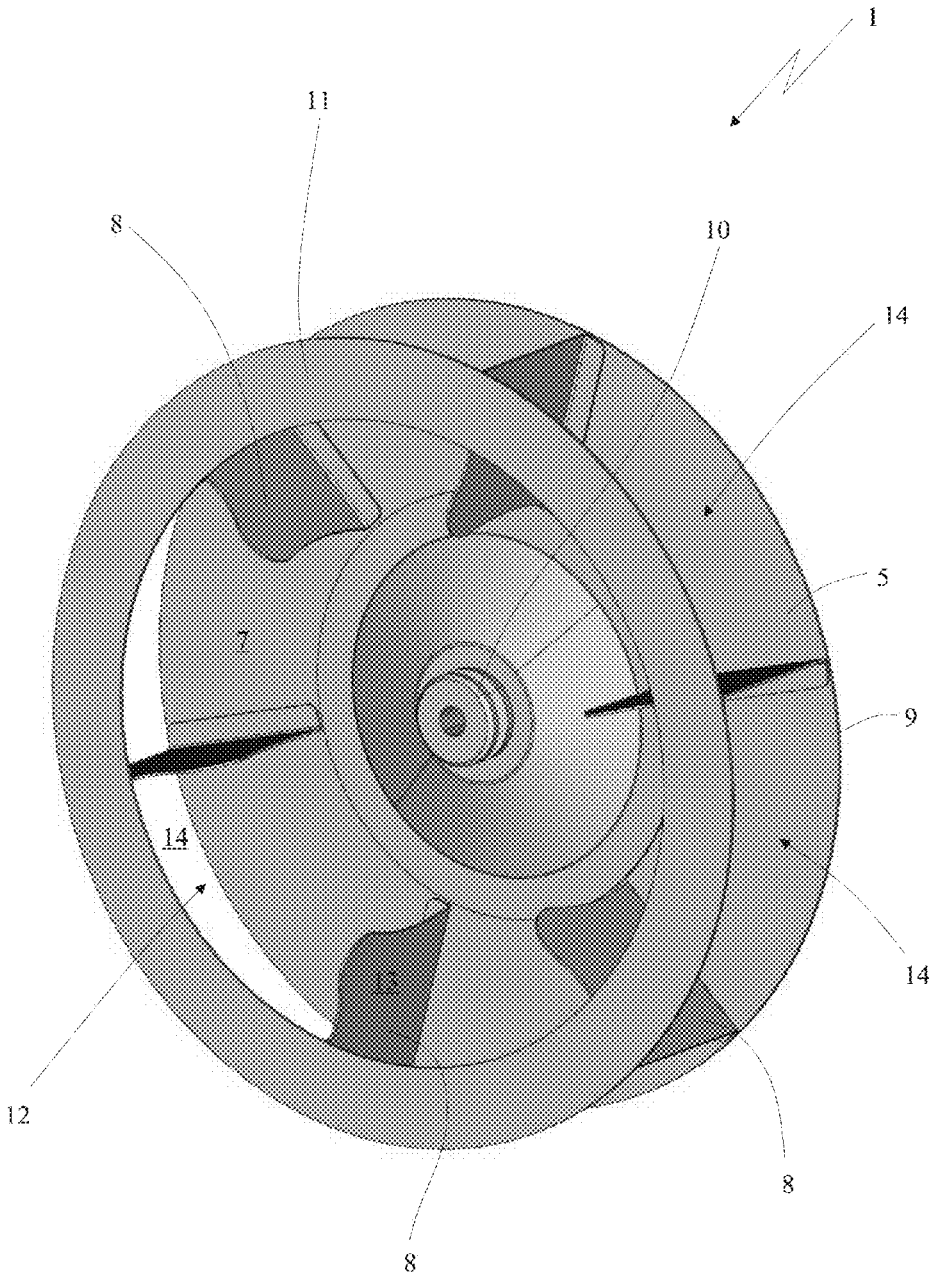
FIG. 2 illustrates a perspective view of the fan, object of the present invention.
Figure 3:
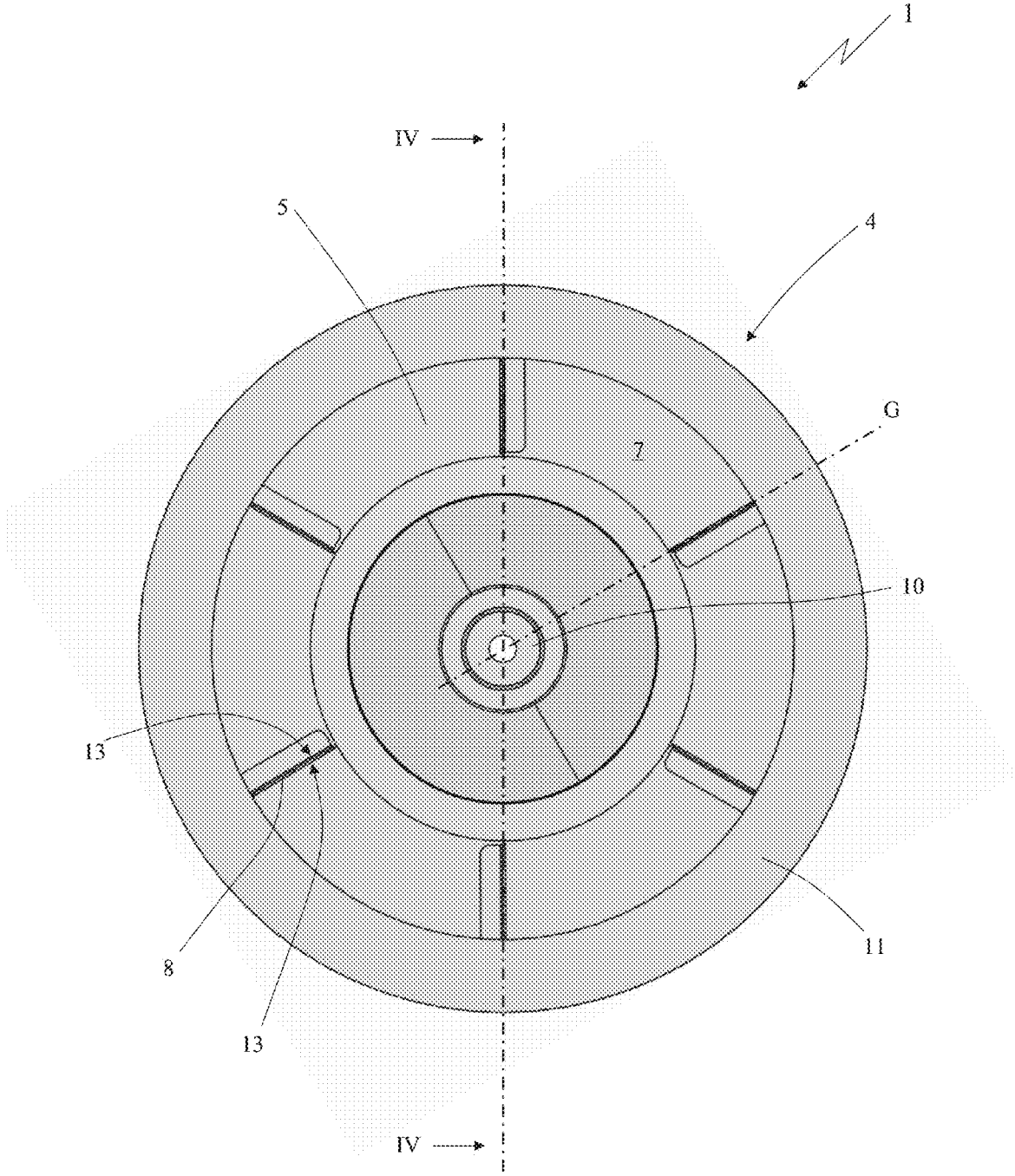
FIG. 3 shows a front view of the fan, object of the present invention.
Figure 4:
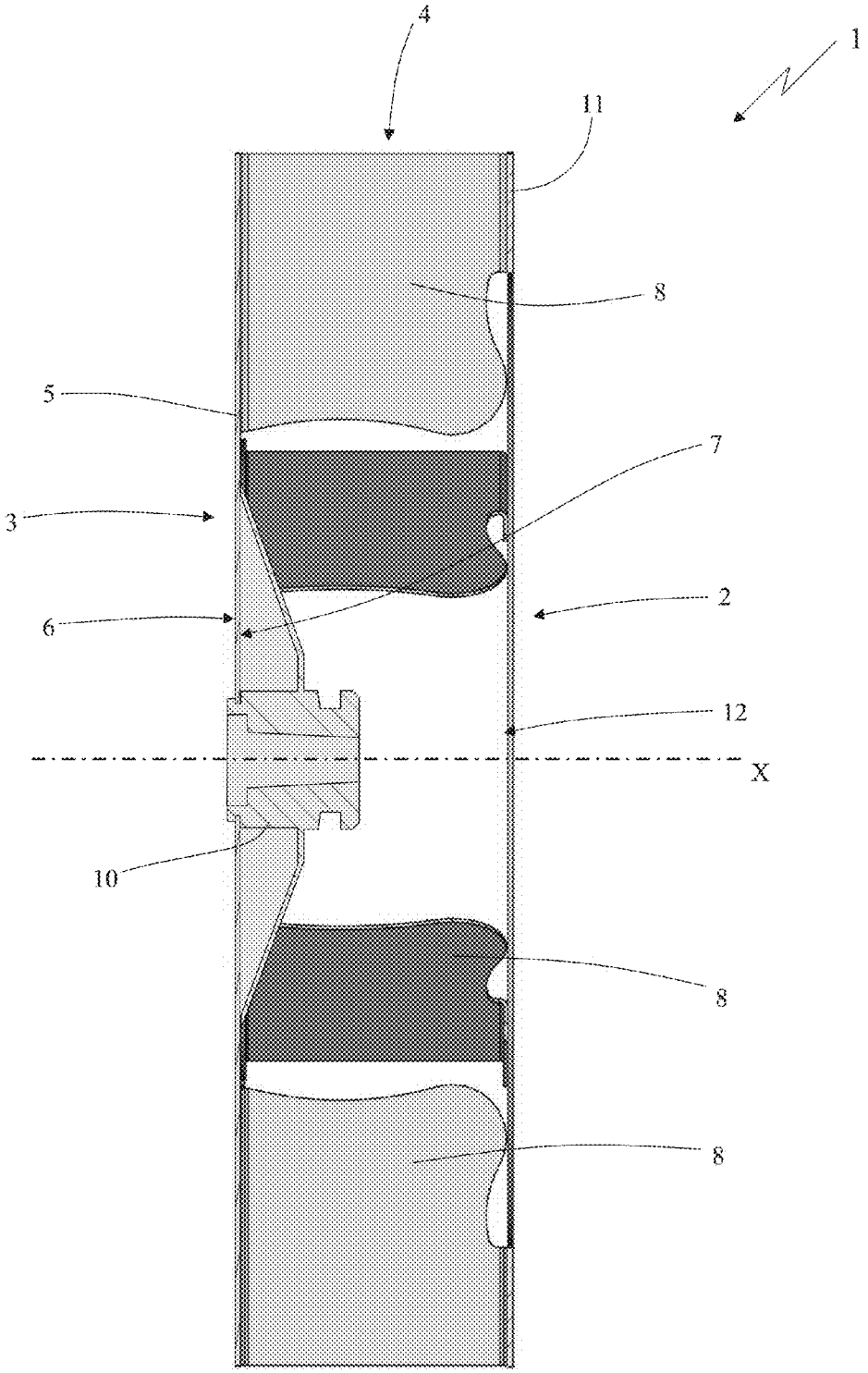
FIG. 4 shows a section view of the fan illustrated in FIG. 3, along line IV-IV of the FIG. 3 itself.

In accordance with the embodiment illustrated in FIGS. 2-4, the fan, preferably of centrifugal type, 1 is provided with a rotation axis X, which is advantageously intended to be arranged aligned with the rotation shaft 112, and around which the fan 1 is drivable to rotate by the aforesaid movement means 113.

According to the invention, the fan 1 is extended along the aforesaid rotation axis X between a front side 2 and a rear side 3 directed in opposite directions with respect to each other, and is provided with a peripheral side 4, which is extended around the rotation axis X between the front side 2 and the rear side 3.

More in detail, the fan 1 comprises a support plate 5 placed to at least partially close the rear side 3 of the fan 1 itself.

Preferably, the front side 2 of the fan 1 is at least partially open in order to allow the suction of the air from the cooking chamber 103, as described in detail hereinbelow. According to the embodiment illustrated in the enclosed figures, the support plate 5 substantially lacks openings for the passage of the air, therefore allowing the suction of the air only from the front side 2 of the fan 1.

In accordance with a different, non-illustrated embodiment, the support plate 5 of the fan 1 is provided with one or more through openings in order to allow the suction of the air also from the rear side 3 of the fan 1 itself.

The support plate 5 of the fan 1 is arranged substantially orthogonal to the rotation axis X and is provided with a first face 6, which delimits the rear side 3 of the fan 1, and with a second face 7 directed towards the front side 2 of the fan 1 itself.

The fan 1 also comprises multiple blades 8 projectingly fixed on the second face 7 of the support plate 5 and arranged around the rotation axis X.

In accordance with the embodiment illustrated in FIGS. 2-4, the support plate 5 of the fan 1 has substantially circular shape, with center aligned with the rotation axis X, and is provided with a perimeter edge 9 along which the blades 8 of the fan 1 itself are arranged.

In particular, the support plate 5 centrally bears a hub 10 fixed thereto, which is intended to be fixed to the rotation shaft 112 that is drivable for moving the fan 1.

Advantageously, the fan 1 comprises a front ring 11, which is arranged on the front side 2 of the fan 1 itself, is extended around the rotation axis X and is fixed to the blades 8. In particular, the front ring 11 at its interior delimits a suction opening 12 of the front side 2 of the fan 1, arranged substantially aligned with the rotation axis X, and the air passes through such opening 12 which is suctioned by the rotating fan 1.

Suitably, the support plate 5, the blades 8 and preferably the front ring 11 of the fan 1 are made of metal material, in particular stainless steel.

Of course, without departing from the scope of the present patent, the fan 1 can be made of any other material suitable for the operating conditions in which the fan 1 itself is intended to function. For example, the fan 1 can also be made of plastic material, in particular if used in an oven adapted for cooking foods at low temperature.

Advantageously, the blades 8 of the fan 1 are arranged around the rotation axis X equidistant from the latter, preferably along a circular trajectory, and are in particular regularly distributed around the rotation axis X itself.

Advantageously, the blades 8 of the fan 1 have substantially plate-like shape, in particular extended orthogonal to the second face 7 of the support plate 5.

Advantageously, the blades 8 are arranged parallel to the rotation axis X and are radially positioned with respect to the latter.

Preferably, the blades 8 are separated from each other by delivery openings 14 made along the peripheral side 4 of the fan 1, and through such delivery openings 14 the air is radially blown under pressure into the cooking chamber 103, as described in detail hereinbelow.

Suitably, the fan 1 comprises a number of blades 8 comprised between three and eight and, preferably, there are six blades 8.

Advantageously, the fan 1 is arranged inside the cooking chamber 103 of the oven 100 with its rear side 3 substantially adjacent and parallel to one of the walls 104-107 of the support structure 102, and is preferably positioned substantially at the center of such wall 104-107. In particular, in accordance with the embodiment illustrated in FIG. 1, the fan 1 is arranged with its rear side 3 directed towards the bottom wall 107 of the support structure 102 and with its front side 2 directed towards the access opening 108. Advantageously, the fan 1 is positioned with its rear side 3 adjacent to the bottom wall 107, and is arranged in particular in position substantially equidistant from the lower 104, upper 105 and lateral 106 walls.

In operation, the fan 1, when it is rotated by means of the driving of the movement means 113, suctions an air flow from the cooking chamber 103 through the open front side 2 of the fan 1 itself, and radially expels the air from the peripheral side 4 thereof through the delivery openings 14.

Advantageously, the heating means 110 of the oven 100 comprise at least one electrical heating element 115 with substantially circular shape and arranged around the peripheral side 4 of the fan 1, in a manner so as to intercept the air that exits under pressure from the delivery openings 14 of the fan 1 itself, in order to transfer the heat to the air, so to heat it.

Advantageously, the oven 100 comprises a conveyance panel 116 arranged inside the cooking chamber 103 and positioned in front of the front side of the fan 1, in a manner such to delimit, with the bottom wall 107 of the support structure 102, an interspace 117 within which the fan 1 itself is positioned. Such conveyance panel 116 is in particular arranged between the fan 1 and a space of the cooking chamber 103 in which the foods to be cooked are intended to be arranged.

Advantageously, the conveyance panel 116 is arranged substantially orthogonal to the rotation axis X of the fan 1, and is provided with multiple passage openings 118 positioned in front of the front side 2 of the fan 1 itself, in order to allow the latter to suction the air from the space of the cooking chamber 103.

The conveyance panel 116 is provided with an external edge 119, which delimits with the lower 104, upper 105 and lateral 106 walls of the oven 100 at least one slit 120 through which the air flow generated in delivery by the fan 1 exits from the interspace 117 in order to be distributed inside the space of the cooking chamber 103 in which the foods to be cooked are arranged. In particular, such air flow, which exits from the interspace 117, hits the lower 104, upper 105 and lateral 106 walls of the oven 100, and flows towards the center of the cooking chamber 103, being suctioned once again by the fan 1, in a manner such to generate a circulation of air inside the cooking chamber 103. With reference to the embodiments illustrated in FIGS. 5, 6 and 7, each blade 8 of the fan 1 is provided with a rear edge 15 fixed to the second face 7 of the support plate 5, with an external edge 16 arranged on the peripheral side 4 of the fan 1, and with an internal edge 17 placed to connect between the external edge 16 and the rear edge 15. In accordance with the idea underlying the present invention, the internal edge 17 of each blade 8 is shaped with a convex portion 18 which is projectingly extended between a first and a second concavity 19, 20 of the internal edge 17 itself.

Figure 5:
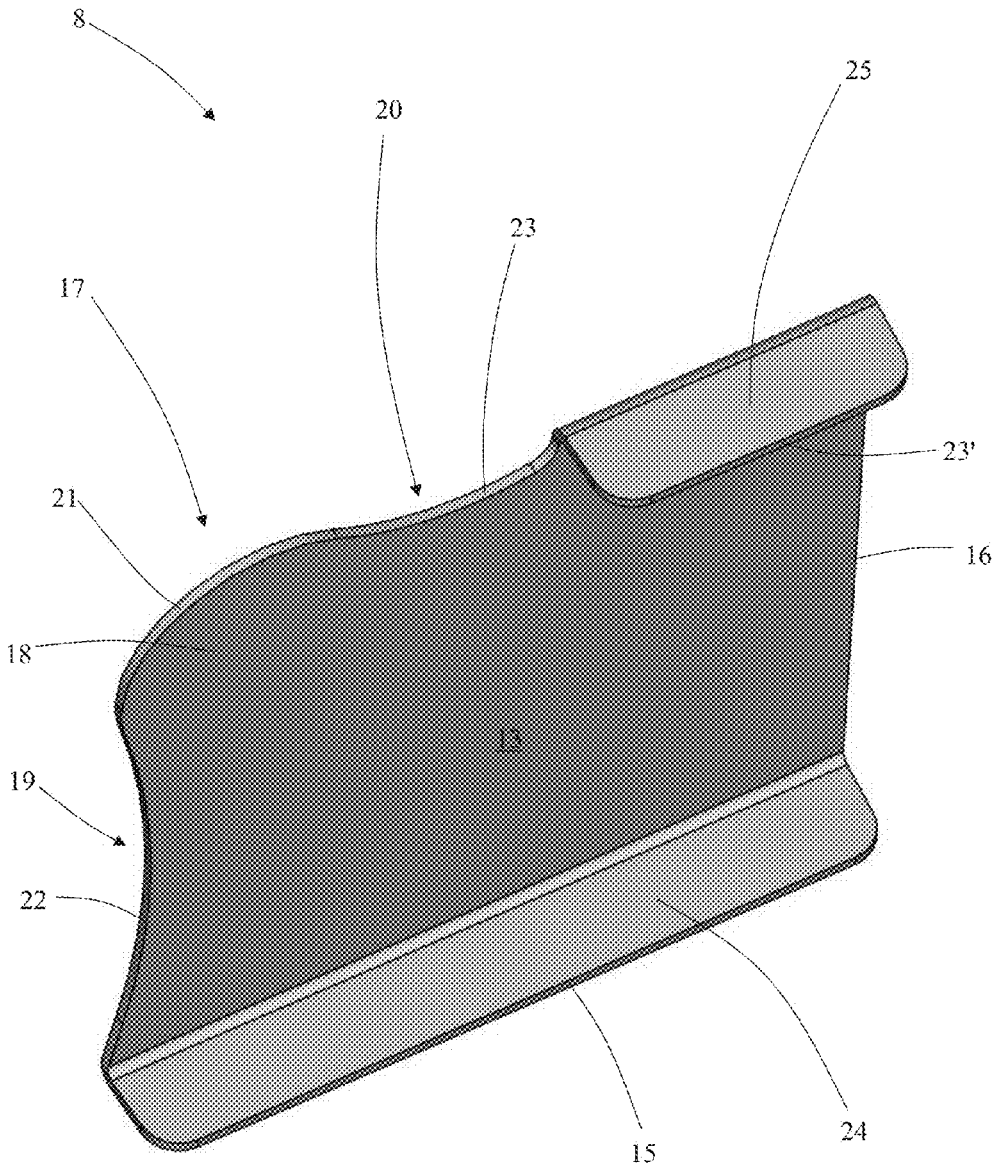
FIG. 5 shows a perspective view of a detail of the present fan, relative to a blade of the fan itself.
Figure 6:
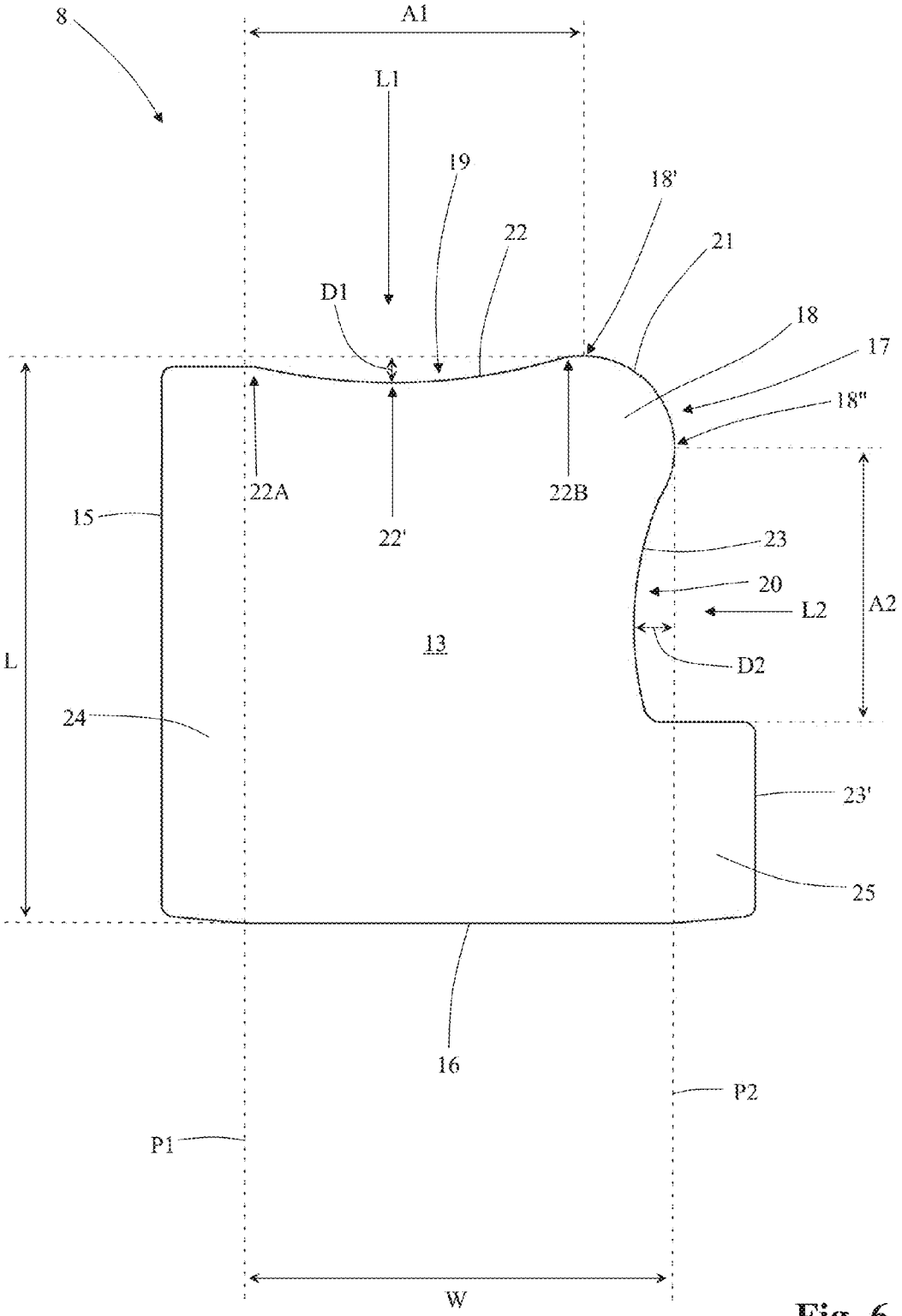
FIG. 6 shows a side view of the blade illustrated in FIG. 5, in which the fixing portions of the blade are represented extended parallel to the lateral faces of the blade itself.
Figure 7:
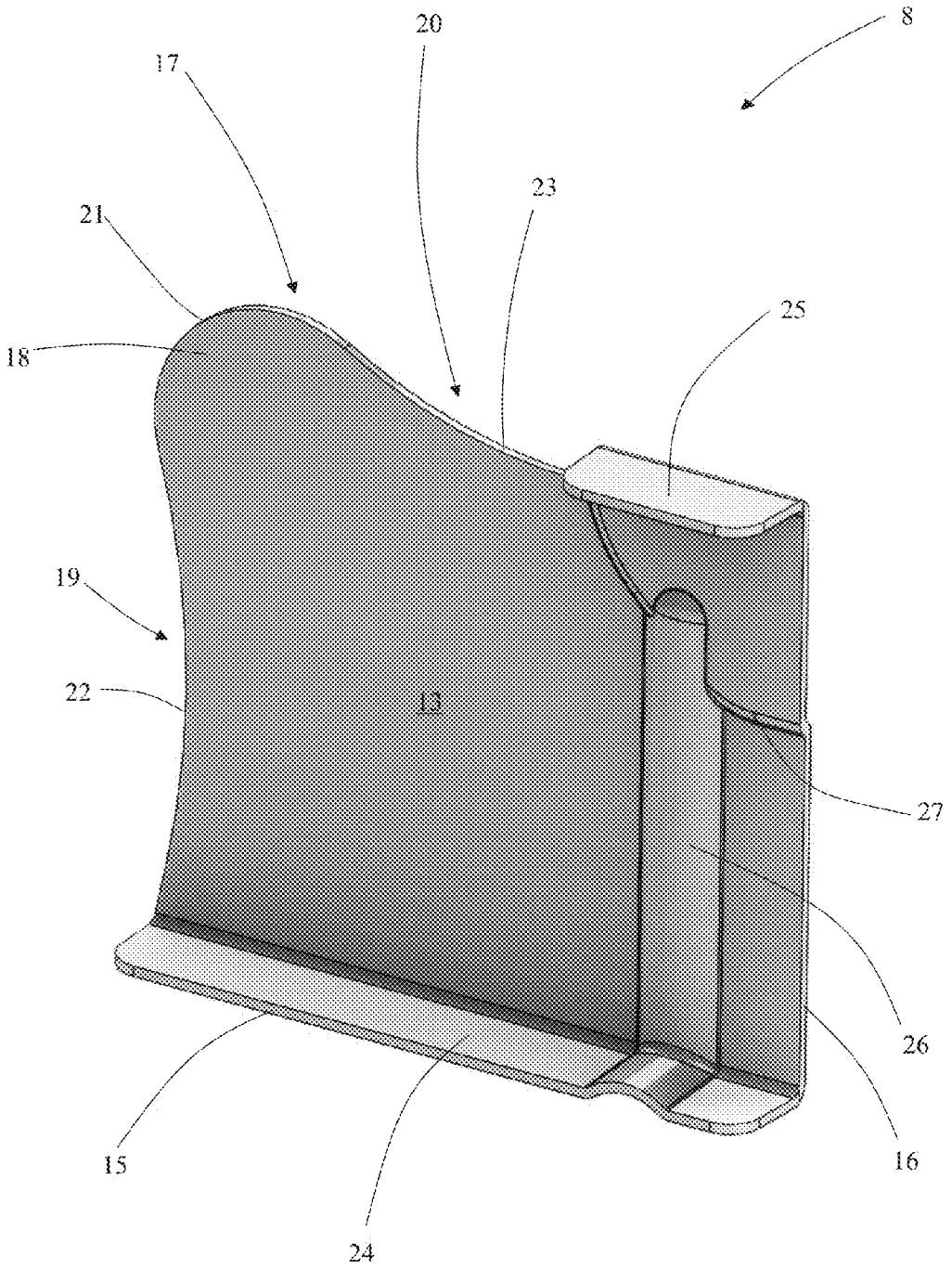
FIG. 7 shows a perspective view of a blade of the fan, in accordance with an embodiment variant of the present invention.

More in detail, with reference to the embodiments illustrated in FIGS. 5, 6 and 7, the internal edge 17 of each blade 8 comprises a first section 21 which delimits the aforesaid convex portion 18, which is projectingly extended at least towards the rotation axis X of the fan 1 and, preferably, also towards the front side 2 of fan 1 itself.

In addition, the internal edge 17 of each blade 8 comprises a second section 22, which delimits the aforesaid first concavity 19 and is extended between the aforesaid first section 21 and the rear edge 15 of the blade 8 itself, and a third section 23, which delimits the aforesaid second concavity 20 of the blade 8 and is extended between the first section 21 and the external edge 16 of the blade 8 itself.

In particular, each blade 8 is provided with only one aforesaid first concavity 19, which is arranged between the convex portion 18 and the rear edge 15 of the blade 8, and is provided with only one aforesaid second cavity 20, which is arranged between the convex portion 18 and the external edge 16 of the blade 8 itself.

Preferably, the first section 21, the second section 22 and the third section 23 of the internal edge 17 of each blade 8 lie on a same radial lying plane G parallel to the rotation axis X of the fan 1 and passing through the rotation axis X itself.

Advantageously, each blade 8 is provided with two faces 13 parallel to each other and directed in opposite sense with respect to each other.

In accordance with the particular embodiment illustrated in FIGS. 2-6, each blade 8 of the fan 1 has its faces 13 substantially flat.

In accordance with an embodiment variant of the present invention illustrated in FIG. 7, each blade 8 of the fan 1 is provided with one or more ribs obtained on the faces 13 of the blade 8 itself. In particular, each blade 8 is provided with a first rib 26 substantially rectilinear and parallel to the external edge 16 of the blade 8, and a second rib 27 with curved form, extended between the third section 23 of the internal edge 17 and the external edge 16 of the blade 8 and preferably intersecting with the aforesaid first rib 26.

Advantageously, the first section 21 (which delimits the convex portion 18) of the internal edge 17 of each blade 8 has curved form, and is extended in particular along an arc of circumference with angle at the center comprised between about 120° and 160° and preferably of about 140-1500.

Preferably, the second and the third section 22, 23 of the internal edge 17 of each blade 8 (which respectively delimit the first and second concavity 19, 20 of the blade 8 itself) have curved form and, in particular, are connected without interruption with the first section 21 of the internal edge 17 of the corresponding blade 8.

Advantageously, the second section 22 (which delimits the first concavity 19) of the internal edge 17 of each blade 8 is directed towards the rotation axis X of the fan 1 and, preferably, the third section 23 (which delimits the second concavity 20) of the internal edge 17 faces the front side 2 of the fan 1 itself.

Advantageously, the external edge 16 of each blade 8 has substantially rectilinear shape and is arranged in particular at the perimeter edge 9 of the support plate 5 of the fan 1. Preferably, the rear edge 15 of each blade 8 has a substantially rectilinear shape and advantageously delimits a rear fixing portion 24 of the blade 1 itself; such fixing portion 24 is bent, in particular at right angle, with respect to the faces 13 of the blade 8 and it is fixed to the second face 7 of the support plate 5, e.g. by means of caulking and/or welding.

Advantageously, a part 23' of the third section 23 of the internal edge 17 of each blade 8 delimits a front fixing portion 25 of the blade 8 itself; such fixing portion 25 is extended between the second concavity 20 and the external edge 16 of such blade 8, and is directed towards the front side 2 of the fan 1.

In particular, the front fixing portion 25 of each blade 8 is bent, preferably at right angle, with respect to the faces 13 of the blade 8 itself, and it is fixed to the front ring 11 of the fan 1, e.g. by means of caulking and/or welding.

In the embodiment illustrated in FIG. 6, the blade 8 is represented for the sake of description simplicity with the fixing portions 24, 25 extended parallel to the faces 13 of the blade 8 itself. In particular, in FIG. 6, a first and a second bend line P1, P2 (dashed lines) are represented, along which the rear 24 and front 25 fixing portion of the blade 8 are respectively bent.

Advantageously, the first concavity 19 of the internal edge 17 of each blade 8 has a first width A1 which is extended for at least half the width W of the blade 8 along the extension of the latter parallel to the rotation axis X of the fan 1, and in particular for about three-quarters of the aforesaid width W.

Preferably, the first concavity 19 of the internal edge 17 of each blade 8 has a first depth D1 comprised between 1/10 and 1/30 of the length L of the blade 8 along the extension of the latter orthogonal to the rotation axis X of the fan 1, and in particular of about 1/20 of the aforesaid length L.

Advantageously, the second concavity 20 of the internal edge 17 of each blade 8 has a second width A2 extended for at least one-third of the length L of the blade 8, and in particular for about half the aforesaid length L.

Preferably, the second concavity 20 of the internal edge 17 of each blade 8 has a second depth D2 comprised between 1/5 and 1/15 of the width W of the blade 8, and in particular of about 1/10 of the aforesaid width W.

In particular, the width W of each blade 8 is defined as the distance between the bend lines P1, P2 of the fixing portions 24, 25 of the blade 8 itself.

The length L of each blade 8 is defined as the distance between the external edge 16 of the blade 8 and the point of the first section 21 of the internal edge 17 closest to the rotation axis X of the fan 1.

Advantageously, with reference to the embodiment illustrated in FIG. 6, the internal edge 17 of each blade 8 is provided with a first side L1, directed towards the rotation axis X of the fan 1, and with a second side L2, which faces the front side 2 of the fan 1 itself.

The second section 22 of the internal edge 17 (and therefore the first concavity 19) is extended on the aforesaid first side L1 of the internal edge 17, and the third section 23 (and therefore the second concavity 20) is extended on the second side L2 of the internal edge 17 itself.

Preferably, the first section 21 of the internal edge 17 of each blade 8 is placed to connect between the first side L1 and the second side L2 of the internal edge 17 itself, and in particular is placed to connect between the second section 22 and the third section 23 of the internal edge 17.

Advantageously, the convex portion 18 projectingly juts from the first side L1 of the internal edge 17 of the blade 8 with respect to the first concavity 19 of the blade 8 itself, and projectingly juts from the second side L2 of the internal edge 17 with respect to the second concavity 20 of the blade 8.

In particular, the convex portion 19 is projectingly extended between only one aforesaid first cavity 19 and only one aforesaid second concavity 20.

Preferably, the first side L1 of the internal edge 17 of each blade 8 is substantially orthogonal to the second side L2 of the internal edge 17 itself. In particular, with such expression it is intended that the main extension direction of the first side L1 is substantially orthogonal to the main extension direction of the second side L2. In particular, by substantially orthogonal it is intended that the first side L1 forms with the second side L2 an angle comprised between 800 and 100° and preferably about 90°.

Advantageously, the second section 22 of the internal edge 17 of each blade 8 is provided with two apical points 22A, 22B, preferably end points, between which the first concavity 19 is extended.

In particular, the second section 22 is provided with a first apical point 22A arranged at the rear edge 15 of the blade 8, and with a second apical point 22B preferably placed to connect to the first section 21 of the internal edge 17.

The second section 22 of the internal edge 17 of each blade 8 is also provided with a bottom section 22' which is arranged between the apical points 22A, 22B of the second section 22 itself.

Such bottom section 22' is arranged at a greater distance from the rotation axis X of the fan 1 with respect to the apical points 22A, 22B of the second section 22.

In particular, by bottom section 22' of the second section 22 it is intended the section of the latter arranged at the maximum depth of the first concavity 19 delimited by the second section 22 itself.

Preferably, at least one sector of the convex portion 18 of each blade 8 is placed at a lesser distance from the rotation axis X of the fan 1 with respect to the bottom section 22' of the second section 22, so that such sector is projectingly extended with respect to the first concavity 19 towards the rotation axis X.

Advantageously, the convex portion 18 of each blade 8 is provided with an internal apex 18' which is arranged at a lesser distance from the rotation axis X of the fan 1 with respect to the first concavity 19 of the blade 8 itself (and in particular with respect to the second section 22 which delimits the first concavity 19).

In particular, the internal apex 18' of the convex portion 18 is arranged at a lesser distance from the rotation axis X of the fan 1 with respect to the first apical point 22A of the second section 22 of the internal edge 17.

Advantageously, the second section 22 of the internal edge 17 of each blade 8 is spatially separated from the hub 10 of the fan 1. In particular, the first apical point 22A of the second section 22 is spaced from the hub 10 of the fan 1.

Preferably, the convex portion 18 of each blade 8 is provided with a front apex 18" which is arranged in advanced position on the front side 2 of the fan 1 with respect to the second concavity 20 of the blade 8 itself (and in particular with respect to the third section 23 which delimits the second concavity 20).

In particular, the front apex 18" of the convex portion 18 is substantially aligned with the second bend line P2 of the front fixing portion 25 of the blade 8.

In operation, when the fan 1 is rotated by means of the driving of the movement means 113, the blades 8 of the fan 1 generate reduced pressure around the rotation axis X of the latter, in a manner such to suction the air from the cooking chamber 103 of the oven 100, until the air is made to enter into the suction opening 12 of the front side 2 of the fan 1.

The blades 8 of the fan 1 confer pressurized energy to the suctioned air, radially projecting it through the delivery openings 14 of the peripheral side 4, in a manner such to generate the circulation of air flows inside the cooking chamber 103 of the oven 100. In particular, the air flows that exit from the delivery openings 14 of the fan 1 intercept the electrical heating element 115 of the heating means 110, which transfer heat to the air in a manner such that the air flows transport the heat through the cooking chamber 103 in order to cook the foods.

The blades 8 of the fan 1, shaped with the convex portion 18 and the two concavities 19, 20 according to the invention, convey the pressurized air through the delivery openings 14 of the fan 1, generating air flows that surprisingly have a substantially laminar progression of the limit layer of the air on the faces 13 of the blades 8, consequently involving low friction between the air and the blades 8 themselves.

More in detail, the convex portion 18 and the two concavities 19, 20 of each blade 8 operate on the air flow suctioned by the front side of the fan 1 and which tends to have a vortical motion, in particular at the central rotation axis X of the fan 1. It was surprisingly verified that the blades 8 of the fan 1 according to the invention operate on the aforesaid flow with vortical motion, facilitating the channeling thereof through the delivery openings 14 between the blades 8. This therefore determines a conveyance of the air flow along a radial direction (with respect to the rotation axis X) and with a substantially laminar motion, significantly reducing the air turbulences and hence decreasing the friction between the air and the blades 8 themselves.

Therefore, reduced energy delivery is required by the motor 114 in order to rotate the fan 1, with a consequent high energy efficiency.

Figure 8:
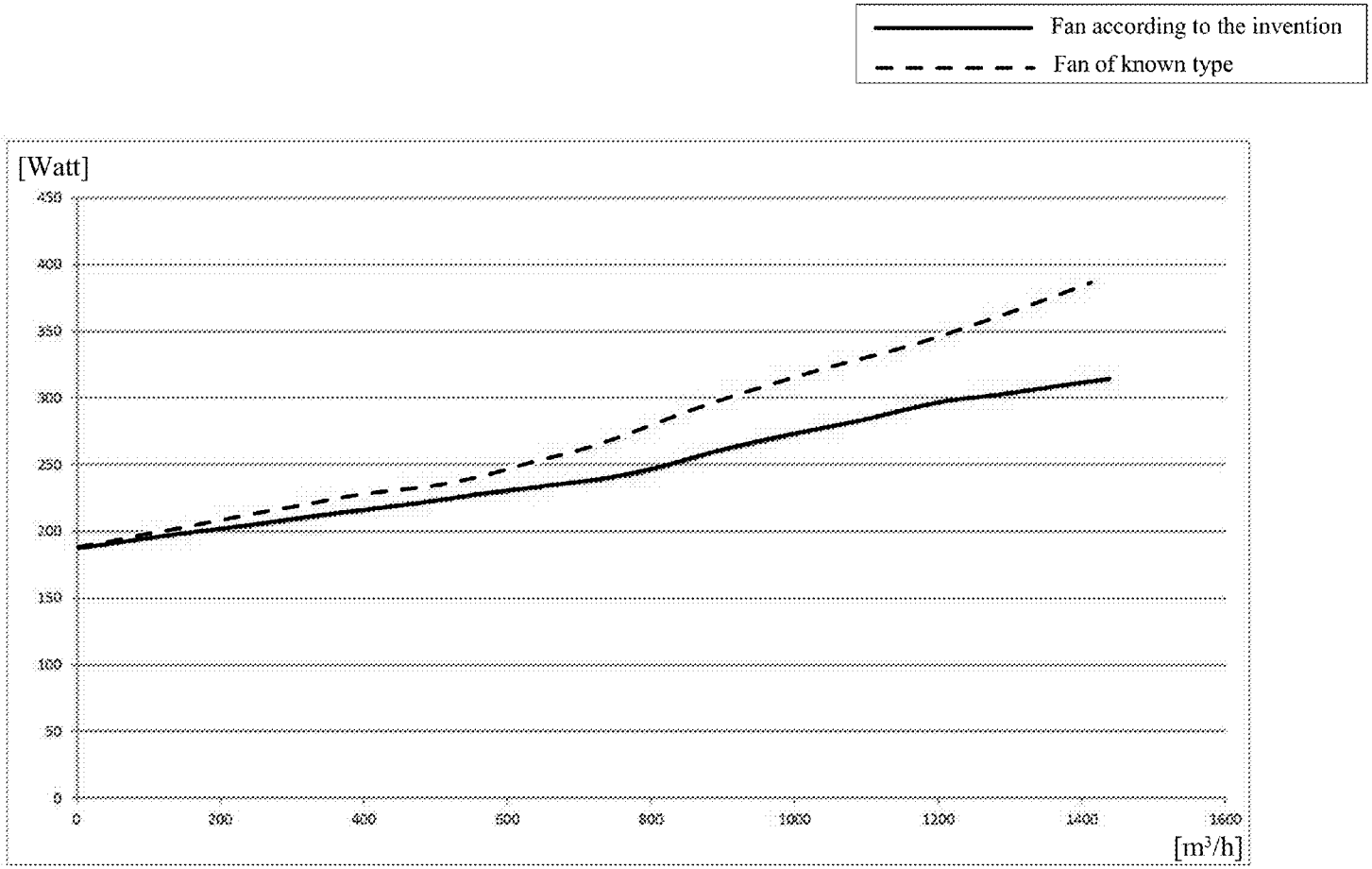
FIG. 8 shows a graph which represents the progression of the power absorbed by a motor in order to drive the present fan 1 and a fan of known type (as a function of the rate of air flow generated by the fans themselves).

Such surprising advantage is shown in the graph illustrated in FIG. 8, which represents the progression of the power absorbed by the motor 114 in order to rotate, at 1500 revolutions/minute, the present fan 1 and a fan of known type (as a function of the air flow rate generated by the fans themselves).

More in detail, the graph of FIG. 8 relates to the results obtained with one embodiment of the present fan 1 having 350 mm diameter, 80 mm thickness between the front and rear face, and provided with six blades 8. Of course, analogous results are also obtainable if the fan 1 is provided with dimensions different from those of the above-indicated embodiment, by advantageously maintaining the same size proportions.

The fan of known type used for obtaining the graph of FIG. 8 has 350 mm diameter, 80 mm thickness between the front and rear face, and is provided with twelve blades, each of which having an internal profile that conventionally has a rectilinear progression, being tapered from the rear support plate to the front ring.

The graph of FIG. 8 shows that, given the same flow rate, the absorption of power by the motor 114 for driving the present fan 1 (depicted with solid line) is significantly less than power absorption for driving the fan of known type (depicted with dashed line).

For example, in order to generate a flow rate of 1400 $m^3/h$, the fan of known type requires a consumption of 390 W, while the present fan 1 requires a consumption of 312 W with a consequent reduction of the power absorption by 20%.

In addition, given the same power absorbed by the motor 114, the present fan 1 generates a flow rate of the air flow greater than that generated by the fan of known type. For example, with a 300 W power absorption of the motor, the fan of known type generates an air flow with a flow rate of 900 $m^3/h$, while the present fan 1 generates an air flow with a flow rate of 1220 $m^3/h$, with a flow rate increase of more than 30%.

In addition, given the same number of revolutions and flow rate, the present fan 1 has a sound level reduced by 15 dB with respect to the aforesaid fan of known type.

In addition, the aforesaid characteristics of the blades 8 of the fan 1 according to the invention allow, given the same flow rate delivered by the fan 1 itself, to make the latter with reduced dimensions (in particular with regard to the diameter and thickness between the front side 2 and rear side 3) with consequent savings in the construction of the fan 1 and further decrease of energy consumptions of the motor 114.

The invention thus described therefore attains the pre-established objects.

The invention claimed is:

1. Fan (1) for ovens for cooking foods, which is provided with its own rotation axis (X) and is extended along said rotation axis (X) between a front side (2) and a rear side (3) directed in opposite directions with respect to each other, and is provided with a peripheral side (4) which is extended around said rotation axis (X) between said front side (2) and said rear side (3);

said fan (1) comprising:

a support plate (5), which is arranged substantially orthogonal to said rotation axis (X) and is provided with a first face (6), which delimits the rear side (3) of said fan (1), and a second face (7) directed towards the front side (2) of said fan (1);

multiple blades (8) projectingly fixed on the second face (7) of said support plate (5) and arranged around said rotation axis (X);

each said blade (8) being provided with:

a rear edge (15) fixed to the second face (7) of said support plate (5);

an external edge (16) arranged on the peripheral side (4) of said fan (1);

an internal edge (17) placed to connect between said external edge (16) and said rear edge (15);

said fan (1) being characterized in that the internal edge (17) of each said blade (8) comprises:

a first section (21) which delimits a convex portion (18) of said blade (8) projectingly extended at least towards the rotation axis (X) of said fan (1);

a second section (22) which delimits a first concavity (19) of said blade (8) and is extended between said first section (21) and said rear edge (15);

a third section (23) which delimits a second concavity (20) of said blade (8) and is extended between said first section (21) and said external edge (16).

2. Fan (1) according to claim 1, characterized in that the first section (21) of the internal edge (17) of each said blade (8) has curved form.

3. Fan (1) according to claim 1, characterized in that the convex portion (18) of each said blade (8) projects towards the front side (2) of said fan (1).

4. Fan (1) according to claim 1, characterized in that the second section (22) of the internal edge (17) of each said blade (8) is directed towards the rotation axis (X) of said fan (1).

5. Fan (1) according to claim 1, characterized in that the third section (23) of the internal edge (17) of each said blade (8) faces the front side (2) of said fan (1).

6. Fan (1) according to claim 5, characterized in that one part (23') of the third section (23) of the internal edge (17) of each said blade (8) delimits a front fixing portion (25) of said blade (8), such front fixing portion (25) is extended between said second concavity (20) and said external edge (16) and is directed towards the front side (2) of said fan (1);

said fan (1) comprising a front ring (11) which is arranged on the front side (2) of said fan (1), is extended around the rotation axis (X) of said fan (1) and is fixed to the front fixing portions (25) of said blades (8).

7. Fan (1) according to claim 1, characterized in that the first concavity (19) of the internal edge (17) of each said blade (8) has a first width (A1) extended for at least half the width (W) of said blade (8) along the extension of the latter parallel to said rotation axis (X).

8. Fan (1) according to claim 1, characterized in that the second concavity (20) of the internal edge (17) of each said blade (8) has a second width (A2) extended for at least a third of the length (L) of said blade (8) along the extension of the latter orthogonal to said rotation axis (X).

9. Fan (1) according to claim 1, characterized in that said blades (8) are arranged substantially parallel to the rotation axis (X) of said fan (1) and are radially positioned with respect to said rotation axis (X).

10. Fan (1) according to claim 1, characterized in that the internal edge (17) of said blade (8) is provided with a first side (L1), directed towards the rotation axis (X) of said fan (1), and with a second side (L2) which faces the front side (2) of said fan (1);

said second section (22) extended on said first side (L1) and said third section (23) extended on said second side (L2), said first section (21) being placed to connect between said first side (L1) and said second side (L2).

11. Fan (1) according to claim 10, characterized in that said convex portion (18) projectingly juts from said first side (L1) with respect to said first concavity (19), and projectingly juts from said second side (L2) with respect to said second concavity (20).

12. Fan (1) according to claim 1, characterized in that said convex portion (18) is provided with an internal apex (18') which is arranged at a lesser distance from said rotation axis (X) with respect to said first concavity (19).

13. Fan (1) according to claim 1, characterized in that said second section (22) is provided with:

two apical points (22A, 22B) between which said first concavity (19) is extended;

and with a bottom section (22') which is positioned between said apical points (22A, 22B) and is arranged at a greater distance from said rotation axis (X) with respect to said apical points (22A, 22B).

14. Fan (1) according to claim 2, characterized in that the first section (21) of said internal edge (17) is extended along an arc of circumference with angle at the center comprised between about 120° and 160°.

* * * * *